United States Patent [19]

Atchison

[11] 4,395,847

[45] Aug. 2, 1983

[54] WINDOW CONSTRUCTION

[76] Inventor: Burl H. Atchison, 2507 SE. Shirley Ave., Lacey, Wash. 98503

[21] Appl. No.: 209,958

[22] Filed: Nov. 24, 1980

[51] Int. Cl.[3] ..... E06B 7/00

[52] U.S. Cl. ..... 49/406; 49/450; 49/458; 292/DIG. 46

[58] Field of Search ..... 49/406, 458, 450, 449, 49/61, 63; 160/90, 91; 292/DIG. 46

[56] References Cited

U.S. PATENT DOCUMENTS

| | | | |
|---|---|---|---|
| 2,107,773 | 2/1938 | Axe | 49/450 |
| 2,204,464 | 6/1940 | Axe | 49/450 X |
| 2,483,061 | 9/1949 | Omans . | |
| 3,078,524 | 2/1963 | Minick . | |
| 3,083,419 | 4/1963 | Pennington et al. . | |
| 3,088,177 | 5/1963 | Riegelman . | |
| 3,220,759 | 11/1965 | Miller . | |
| 3,226,779 | 1/1966 | Rust | 49/63 X |
| 3,324,597 | 6/1967 | Rich . | |
| 3,538,642 | 11/1970 | Fredricksen . | |
| 3,795,076 | 3/1974 | Anderson . | |
| 3,808,742 | 5/1974 | Ehret et al. . | |
| 3,893,261 | 7/1975 | Cribben | 49/449 |
| 3,896,589 | 7/1975 | Mitchell . | |
| 4,004,629 | 1/1977 | Kelly . | |
| 4,106,239 | 8/1978 | Bancroft et al. . | |
| 4,185,416 | 1/1980 | Wilmes . | |
| 4,186,522 | 2/1980 | Hooks | 49/63 |

FOREIGN PATENT DOCUMENTS

| | | |
|---|---|---|
| 410582 | 5/1934 | United Kingdom . |
| 956998 | 4/1964 | United Kingdom . |

*Primary Examiner*—Philip C. Kannan

*Attorney, Agent, or Firm*—John O. Graybeal

[57] ABSTRACT

A window construction (20) includes a support frame (22) having a front channel member (52) for receiving a slidable window sash (26), and a rear channel (56) for receiving a fixed window sash (24). Front and rear channels (54) and (56) are divided by a central flange (52). Weatherstrip means (136) are mounted on sashes (24) and (26) to project transversely outwardly from the sashes to press against the adjacent face of support frame central flange (52) and against an adjacent surface of the opposite sash to thereby form an unbroken seal around the entire perimeter of each sash. The support frame 22 also includes a compound shaped mounting flange (32) having a diagonal section (76) extending outwardly and diagonally forwardly from front channel (54), and a perimeter section (78) extending outwardly from the outer edge of the diagonal section (76) to lie in a plane forwardly offset from and substantially parallel to the plane defined by sashes (24) and (26). A latch mechanism (138) is pivotally mounted on slidable sash (24) to extend transversely across the entire width of support frame (22) to engage with portions of the support frame (22) to secure slidable sash (26) in selective open positions or to lock slidable sash (26) in closed position.

12 Claims, 8 Drawing Figures

W
78
32
82
O
76
58
30
40
46
58
20
42
136
62
44
22
102
62
24
90
136
124
94
92
68
108
100
64
124
136
26
162
28
170
172
64
168
90
156
152
154
146
148
170
172
144
160
138
164
142
136
140
150
166
114
110
42
50
124
48
60
46
52
56
58
54
38
76
78

W
78
32
82
76
56
30
34
20
46
54
42
70
104
44
62
96
120
22
130
72
131
24
26
90
90
92
94
68
62
126
130
130
72
98
106
42
44
126
70
66
48
50
52
56
66
54
32
46
36
78

WINDOW CONSTRUCTION

DESCRIPTION

Technical Field

The present invention relates to framed windows, and more particularly to a sliding window construction which can be utilized in either a vertical or horizontal orientation and which minimizes heat transfer through the window frame.

Background Art

Prior art U.S. Pat. Nos. 2,483,061 and 3,083,419 disclose latches for double hung windows wherein a latch fastener is mounted to each side of the lower portion of a slidable window sash. The use of both hands is required to manipulate the two latch fasteners to either engage with or disengage from notches formed along the vertical sides of the window frame. Also, both of the latch fasteners include components constructed with sharp corners which can catch on window dressings or on the body or clothing of a person raising or lowering the window sash.

United Kingdom Pat. No. 410,582 concerns a vertically sliding window for motor vehicles which includes a pivot shaft extending across the upper edge of the window glass. Pawls are attached to each end of the shaft to engage with ratchet teeth formed in vertical guide ribs within which the vertical side portions of the window slide up and down. A center handle is fixed to the shaft for pivoting the pawls into and out of engagement with the ratchet teeth. Because the shaft is mounted at the top of the window, the handle would be out of reach if this type of latch mechanism is used in a double hung window for a house or other type of dwelling. Moreover, this particular type of latch mechanism includes a large number of individual components which must be precisely manufactured and assembled if the window is to operate properly.

U.S. Pat. Nos. 3,795,076 and 4,106,239 involve latches mounted on the lower horizontal member of a vertically sliding sash frame. The latch engages with a strike or receiving mechanism disposed within the frame sill. Consequently, it is not possible to maintain the window latched in selected open positions. The sliding sash can be locked only when it is in fully closed position. United Kingdom Pat. No. 956,998 discloses a window lock somewhat similar to that disclosed in the '706 and '239 U.S. patents; however, with the exception that a pair of latches are mounted to the upper edge portion of a vertically sliding sash frame to engage with catch parts secured to the header of the window frame. Thus, the latch mechanism of this patent is capable of only holding the sliding window panel in fully raised or open position.

U.S. Pat. Nos. 3,808,742 and 4,004,629 provide window latches for window structures which slide horizontally within a frame or casement. A pivoting latch plate is mounted on the outside vertical edge of the window to engage with a keeper plate located within a vertical window frame stile. This type of window frame construction only permits the sliding window to be locked in fully closed position.

U.S. Pat. Nos. 3,078,524; 3,088,177; and 4,106,239 all concern latches for windows having horizontally sliding sashes wherein a rather narrow latch member is pivotally mounted on the inside or meeting stile of the movable sash frame; The latch mechanism engages within a catch provided in the adjacent inside or meeting stile of the stationary window frame. Because this type of latch mechanism interlocks the meeting stiles of the two sashes, the sashes only can be locked in fully closed position. U.S. Pat. No. 3,220,759 discloses a window latch constructed somewhat similarly to the above described '524, '177 and '239 patents, with the exception that this particular latch assembly is adapted to be used in conjunction with a hinged window which pivots about a vertical axis. Nevertheless, the latch assembly also is only operable when the window is fully closed.

U.S. Pat. Nos. 3,088,177; 3,324,597; and 3,896,589 all concern framed windows having horizontally sliding sashes wherein the inside or meeting styles of the sash frame are hooked together when the slidable sash is in closed position. A projection or lip is spaced outwardly from the side surface of one meeting stile in a direction toward the opposite sash to thereby hook or lock with a corresponding lip formed in the other meeting stile. Because the sliding and stationary sashes are removed from and inserted within a support frame by initially sliding the upper edge portion of the sash upwardly into a close fitting channel formed in the header of the window support frame and then lowering the lower edge of the sash into a close fitting channel formed in the sill of the window support frame, the locking projections or lips which extend transversely beyond the sides of the meeting stiles necessarily cannot extend the full height of the meeting stiles or else the sashes could not be removed from the window frame. In the '177 and '589 U.S. Patents, weatherstrip members extend transversely outwardly from the side of the meeting stiles to seal against the adjacent surface of the locking lips of the opposite stile. However, since the locking lips do not extend the full height of the stiles, unsealed openings exist at the upper and lower end portions of the lips which permit cold or hot air to pass by the ends of the lips. In the above identified '597 U.S. patent, weatherstrip members are mounted on the locking lips themselves to seal against an adjacent surface of the other meeting stile. Because the lips do not extend above the lower edge of the window support frame header or below the upper edge of the window support frame sill, the weatherstrip cannot provide a complete seal at the upper and lower portions of the meeting stiles.

U.S. Pat. No. 3,078,524 also discloses a window construction having lips or flanges that hook together to interlock the meeting stiles of the sash frames of the horizontally sliding and stationary sashes. The sliding sash is sealed by a hollow, resilient sealing strip mounted in a rib integrally formed with the window support frame to seal against the side of the sliding sash frame facing the stationary sash. The sealing strip and its associated mounting ribs occupy the same support frame channel that houses the stationary sash. Thus, the window frame must include a third channel to house a screen sash which covers the vent opening created by the sliding sash when it is in open position. To accommodate the third channel, the window frame must be constructed thicker than if the window screen could be mounted within the same channel occupied by the stationary sash.

U.S. Pat. Nos. 3,538,642 and 4,185,416 both concern horizontally sliding sash windows including resilient weather strip members for closing the gap necessarily existing between the meeting styles of the stationary and sliding sash frames. The seal members do not, however, form a complete seal between the upper member of the sash frames and the window frame header nor between the lower member of the sash frames and the window frame sill.

Disclosure of Invention

The present invention relates to a novel window construction especially adapted to be disposed either vertically or horizontally as a storm window in traditional houses or as a primary window in mobile or modular home construction. The window includes a framed stationary sash and at least one framed sliding sash, both mounted on a support frame. The members of the support frame are formed as narrow and thin as possible to not only limit the material required to form the window, but also to minimize the rate of heat transfer through the window frame while still ensuring that the frame is structurally rigid enough to safely support the sashes. The support frame includes a channel portion composed of a rear channel for receiving a stationary sash and a front channel for receiving at least one slidable sash. The channels are in part constructed from a common flange member. A lip member is spaced laterally outwardly from the adjacent sides of the inner or meeting stiles of both of the sash frames so that when the sliding sash is in closed position, the meeting stiles lock together. This prevents relative movement between the meeting stiles, such as when the sashes are subjected to a strong wind. Weatherstrip members are mounted on and extend transversely of the side surfaces of the sash frames to seal against the channel common flange member and against the adjacent side surface of the opposite overlapping meeting stile. This feature has the advantage of completely sealing the sashes to thereby minimize heat loss through the window.

The window construction of the present invention also includes a latch mechanism having an elongate latch plate pivotally mounted on the outer stile of the sliding sash to extend across the width of the window support frame. The latch plate includes a hooked free edge portion selectively engageable within aligned slots formed along the header and sill members of the support frame to thereby secure the slidable sash in selected open positions. The latch plate free edge portion is also engageable with a keeper lip extending along the adjacent stile of the support frame to lock the sliding sash in closed position. This construction has the advantage that the latch can lock the sliding sash in fully closed position or in selective open positions whether the window structure is mounted in a horizontal or vertical orientation.

The present invention also includes a compound shaped mounting flange surrounding the channel portion of the support frame. The mounting flange has a diagonal section extending outwardly and forwardly of the periphery of the support frame channel portion, and a perimeter section extending outwardly from the outer edge of the diagonal section to lie in a plane substantially parallel to the planes defined by the two sashes. This type of construction eliminates the need for any additional members to mount the window frame in a wall opening.

Best Mode for Carrying Out The Invention

Figure 1:
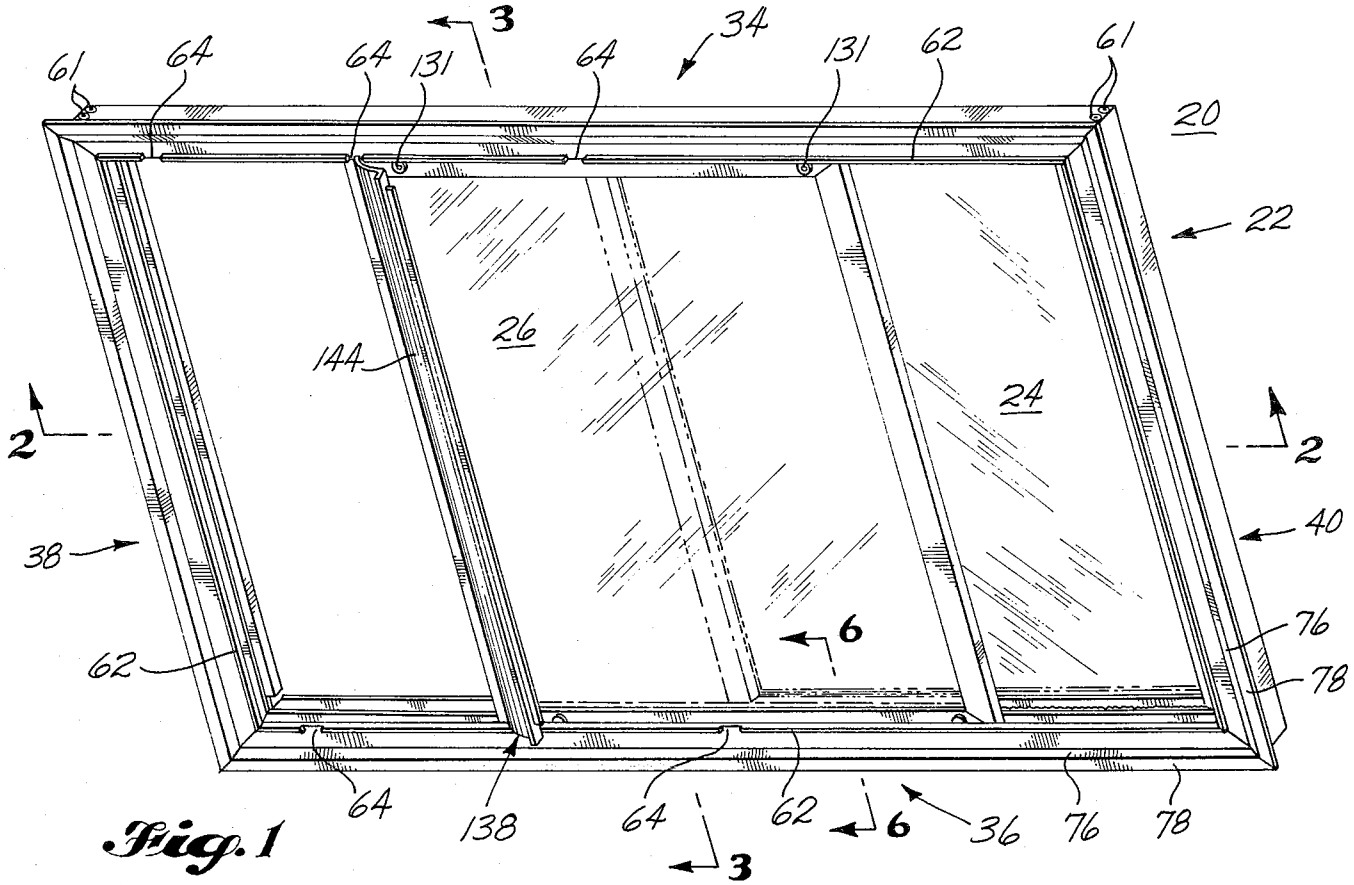
FIG. 1 is an isometric view of a window structure constructed according to one typical embodiment of the present invention wherein the window structure is horizontally disposed.
Figure 2:
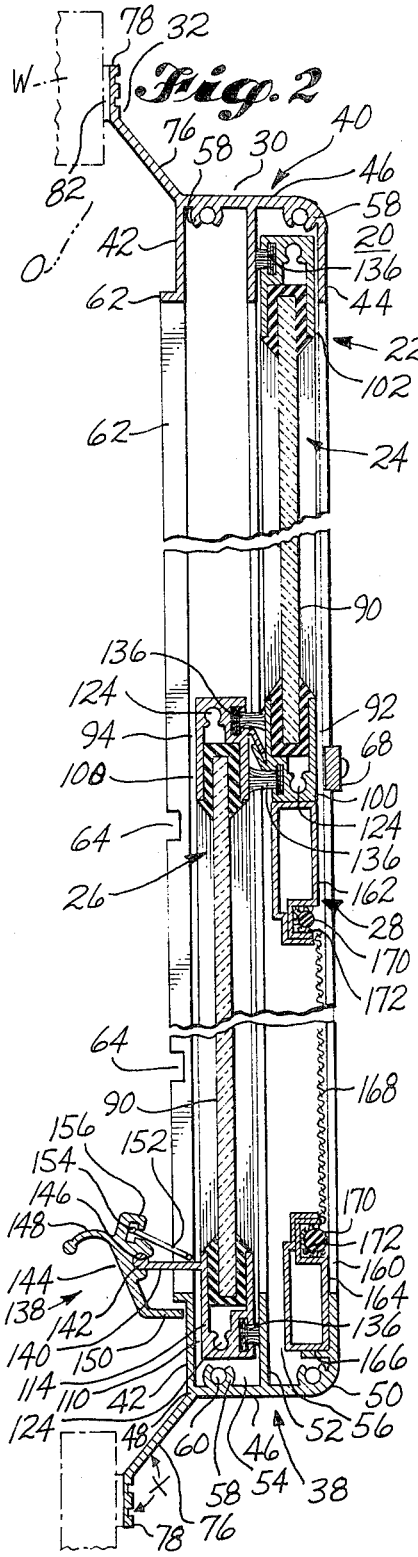
FIG. 2 is an enlarged cross-sectional view, with certain intermediate portions broken away, of the typical embodiment of the present invention illustrated in FIG. 1, taken substantially along lines 2–2 thereof.
Figure 3:
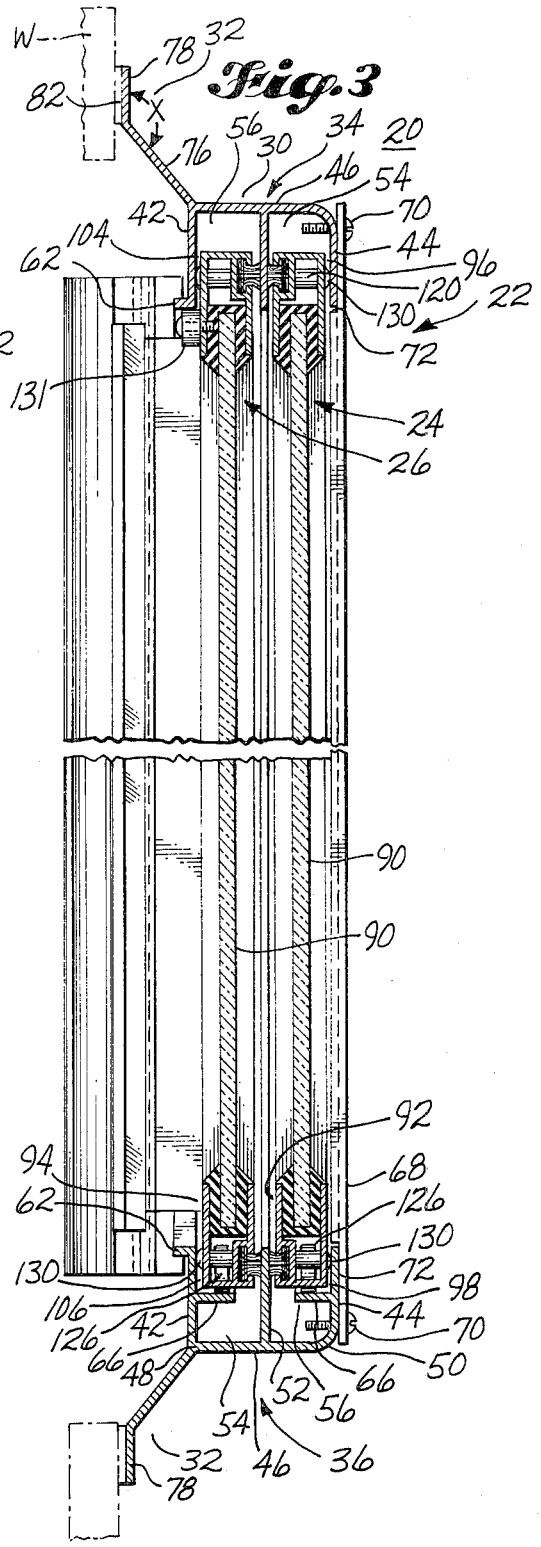
FIG. 3 is an enlarged cross-sectional view, with certain intermediate portions broken away of the typical embodiment of the present invention illustrated in FIG. 1, taken substantially along lines 3–3 thereof.

Referring initially to FIGS. 1–3, a window structure 20 constructed according to the best mode of the present invention presently known to applicant is shown disposed in horizontal orientation. The window structure 20 basically comprises a support frame 22 adapted to receive a fixed window sash 24, a slidable window sash 26 and a screen sash 28. Support frame 22 is composed of a header member 34, a sill member 36, and stile members 38 and 40, which interconnect the end portions of the header and sill members. As discussed more fully below, the header, sill and stile members are securely interconnected together to form a unitary, rigid support frame 22.

Figure 4:
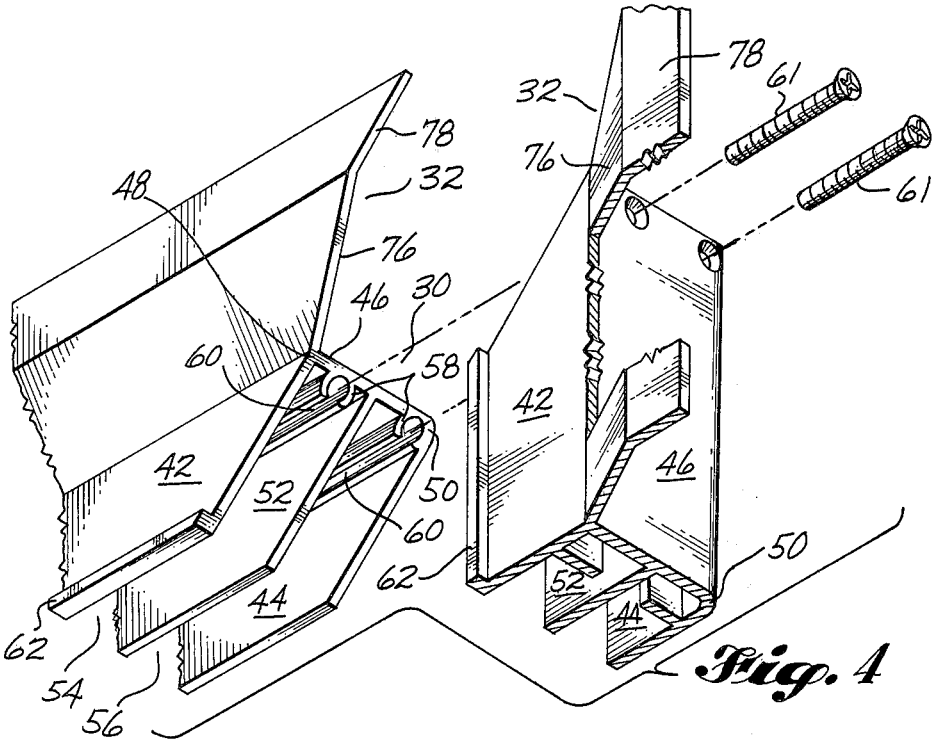
FIG. 4 is a greatly enlarged, fragmentary, exploded, isometric view of a typical embodiment of the present invention specifically illustrating a corner joint of the support frame shown in FIGS. 1–3.
Figure 5:
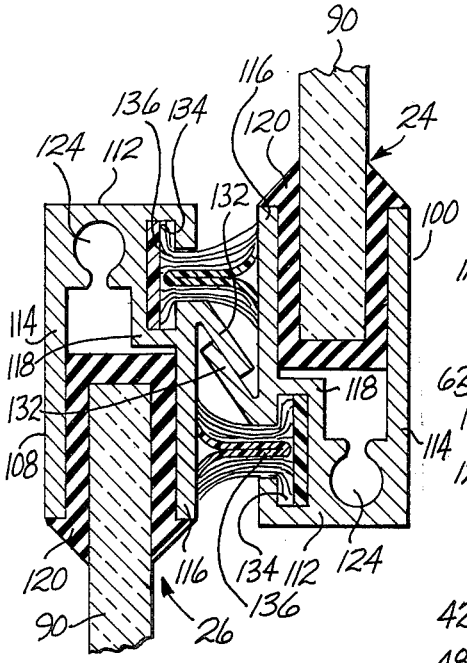
FIG. 5 is a greatly enlarged, fragmentary, cross-sectional view of a typical embodiment of the present invention specifically illustrating the interconnection of the sash frame meeting members.
Figure 6:
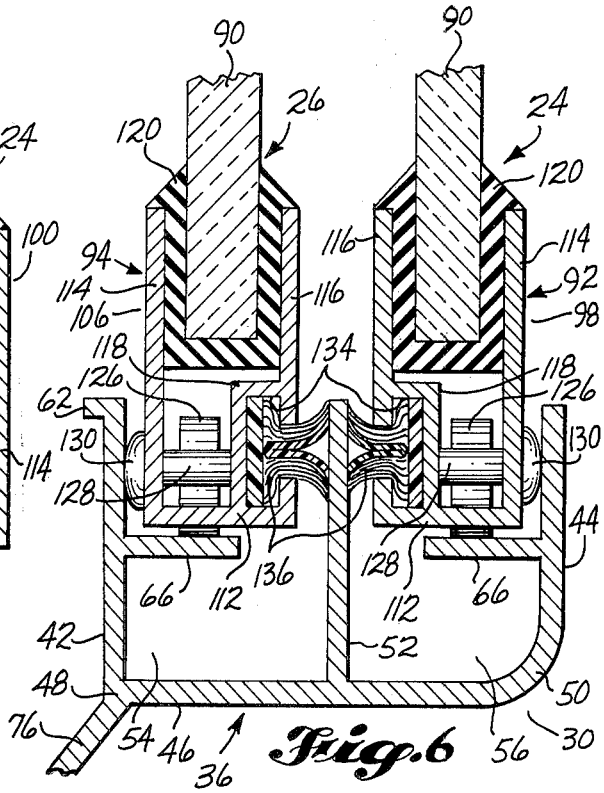
FIG. 6 is a greatly enlarged, fragmentary, cross-sectional view of the typical embodiment of the present invention illustrated in FIG. 1, taken substantially along lines 6–6 thereof.

Referring additionally to FIGS. 4–6, each of the members comprising support frame 22 includes a channel portion 30 which houses sashes 24, 26 and 28; and mounting flange portion 32 integrally formed with channel portion 30. Mounting flange portion 32 is used to mount window structure 20 either in a wall opening O when the window structure is used as a primary window or over an existing window when it is used as a storm window.

With respect to the following description of the best mode of window construction 20, the interior or forward side of support frame 22 refers to the side corresponding to flange portion 32 which is the side of frame 22 that is directed toward the interior or the building. Correspondingly, the exterior or rearward side refers to the side opposite flange portion 32.

Channel portion 30 of each of the support frame members includes a flat, thin, front flange 42 disposed at the interior side of window structure 20 and a complementary, flat, thin rear flange 44 disposed in spaced parallel relationship to front flange 42. A web 46 extends around the outer edge portions of flanges 42 and 44 to cooperate with the flanges to form a generally U-shaped cross section. Web 46 intersects with front flange 42 at a sharp corner 58 and intersects rear flange 44 at a rounded corner 50. Rounded corner 50, which is exposed to the exterior of the structure on which window 20 is mounted, provides a more pleasing appearance than if it was formed sharp. Channel portion 30 also includes a flat, thin center flange 52 disposed parallel to, and preferably centrally between front and rear flanges 42 and 44. Center flange 52 divides channel portion 30 into a front channel 54 and a rear channel 56. Compared to conventional window structures, front, center and rear flanges 42, 54 and 44, respectively, are rather narrow in width to reduce the surface area of frame 22 to thereby minimize the heat transfer rate through the frame.

As best shown in FIGS. 2 and 4, stile members 38 and 40 include a pair of curved ribs 58 which extend longitudinally along the inside surface of web 46, i.e. at the base of channels 54 and 56. Each of the ribs 58 defines an arcuate slot 60 open in the direction opposite to web 46. Support frame 22 is assembled by driving conventional hardware members, such as sheet metal screw 61, through a pair of clearance holes provided in each end portion of header member 34 and sill member 36 to securely engage into a corresponding slot 60. As most clearly illustrated in FIG. 4, the corners of the header, sill and stile members are mitered to give window structure 20 an appealing, "clean" appearance, and to eliminate the need to form the ends of these members in a complicated shape.

Referring to FIGS. 1–4, a lip 62 is formed along the entire length of the free edge portion of front flange 42 to extend a short distance transversely of the front flange in a direction opposite to central flange 52. The portions of lip 62 extending along header member 34 and sill member 36 include a plurality of aligned notches 64 spaced along the length of the header and sill members, FIGS. 1 and 2. Further referring to FIGS. 3 and 6, sill member 36 includes a pair of ledge members 66 cantilevered transversely from front flange 42 and rear flange 44 across front channel 54 and rear channel 56, respectively, towards center flange 52. Ledge members 66 are located at an elevation approximately centrally of the depth of channels 54 and 56.

As shown in FIGS. 2 and 3, window structure 20 also includes a straight, elongate enforcing bar 68 extending transversely across support frame 22 to interconnect the central portions of header member 34 and sill member 36. A threaded fastener 70 extends through a clearance hole provided at each end of bar 68 to threadably engage with an aligned opening formed in rear flange 58. A notch 72 is formed in each end portion of bar 68 of a thickness corresponding to the thickness of rear flange 44 to thereby form a seat for the rear flange.

Window structure 20 further includes a mounting flange portion 32 which surrounds and is preferably integrally formed with channel portion 30 to mount support frame 22 over an opening 0 formed in a wall when window structure 20 is used as a primary window or over an existing window (not shown) when the window structure is used as an insulating or storm type window. Mounting flange portion 32, formed in a compound shape, includes a diagonal section 76 extending outwardly and forwardly from corner 48 of channel portion 30 in a direction opposite central flange 52 to intersect with a perimeter section 78 disposed in a plane parallel to and forwardly of front flange 42. This particular construction spaces channel portion 30 outwardly far enough from any pre-existing window (not shown) which window structure 20 may extend over when serving as a storm window to thereby prevent interference between the preexisting window and window structure 20. Accordingly, the relative angle X, FIGS. 2 and 3, between diagonal section 76 and perimeter section 78 should be small enough to ensure that the mounting flange is not excessively wide, but also large enough to ensure that mounting flange 32 is strong enough to rigidly and safely support channel portion 30 and sashes 24, 26 and 28. Applicant has found that forming mounting flange 32 with angle X in the range of approximately thirty to fifty degrees optimumly fulfills this design criteria. In mounting window structure 20, preferably a thermal insulating member, such as a commonly available type of insulating tape 82, is sandwiched between perimeter flange 78 and wall W to minimize conductive heat transfer between the wall and support frame 22.

Now referring specifically to FIGS. 2 and 3, window structure 20 further includes a slidable sash 26 disposed within front channel 54 and a fixed sash 24 disposed within rear channel 56 of support frame 22. Each sash 24 and 26 includes a glazed panel 90 mounted within a fixed sash frame 92 and a sliding sash frame 94, respectively. Fixed sash frame 92 includes a top member 96 and a bottom member 98 extending along the upper and lower edges of glazed panel 90, and an inner or meeting member 100 and outer member 102 extending along opposite side edges of glazed panel 90 to intersect the top and bottom members.

Likewise, sliding sash frame 94 includes a top member 104, a bottom member 106 interconnected by an inner or meeting member 108 and an outside member 110. When slidable sash 26 is disposed in closed position, as illustrated in FIG. 2, the meeting members 100 and 108 of the fixed and sliding sash frames are disposed at the center of support frame 22 in overlapping adjacent relationship to each other. The members composing fixed and sliding sash frames 92 and 94 are each constructed substantially similarly to each other in a U-shaped cross section defining a channel for receiving the edge portions of glazed panel 90. Accordingly, as most clearly shown in FIGS. 5 and 6, each of the frame members 96–110 includes a base portion 112 and a pair of parallel side walls 114 and 116 extending transversely from base portion 112 to form the sides of the channel shape. A shoulder 118 is formed along the inside surface of side wall 116 to serve as an abutment for glazed panel 90. A U-shaped glazing member 120 extends around the edge portions of glazed panels 90 to seal the glazed panels within sash frame 92 and 94. Preferably glazing member 120 is formed from thermally insulating material such as natural or synthetic rubber.

The members 96–102, each having mitered ends, are assembled together to form sash frame 92 by driving fasteners, such as self-tapping screws, not shown, through the base portions 112 at each end of top member 96 and bottom member 98 to securely engage within a slot 124 of arcuate cross section, extending along the base portions 112 of meeting and outside members 100 and 102, FIGS. 2 and 5. Sliding sash frame 94 is constructed in a similar manner with screws, not shown, extending through a clearance opening in base portion 112 at each end of top member 104 and bottom member 106 to snugly and securely engage within slots 124 formed in meeting member 108 and outside member 110. By these constructions, fixed and sliding sash frames 92 and 94 are constructed in a rigid manner to thereby securely support glazed panels 90.

Both fixed and slidable sashes 24 and 26, respectively, are supported by rollers 126 journaled on cross shafts 128 extending between side walls 114 and 116 of bottom member 98 of fixed sash frame 92 and bottom member 106 of sliding sash frame 94, FIGS. 2 and 6. As illustrated in these figures, substantially the entire circumference of rollers 106 are disposed within the hollow interior of bottom members 98 and 106 with only a very small portion of the rollers extending below the lower surface of base portion 112 to roll on horizontal ledge members 66 of support frame sill member 36. Cross shafts 128 ideally are disposed adjacent each end of bottom members 98 and 106. Moreover, each cross shaft 128 includes a rounded or crowned head 130 overlying the exterior side surfaces of bottom members side walls 114 to bear against the adjacent surfaces of channel flanges 42 and 44. Ideally, head 130 is formed from nylon, Teflon, or plastic or similar material which exhibits a low coefficient of sliding friction with respect to a metal surface, such as that from which support frame 22 is ideally formed. A cross shaft 128 having a crowned head 130 also extends across side walls 114 and 116 at each end of fixed sash frame top member 96 and sliding sash frame top member 104, FIG. 3.

As best shown in FIG. 3, the overall heights of fixed and sliding sashes 24 and 26, respectively, are somewhat less than the overall height of support frame 22. Consequently, a gap exists between the top surface of the sashes and the lower surface of the portion of web 46 of support frame header member 34. This gap is necessary to permit installation and removal of the sashes. The sashes are installed by initally sliding their frame top members 96 and 104 into their respective channels 56 and 54 until their bottom members 98 and 106, respectively, can be swung into alignment with their corresponding channels and then lowered into the channels to set rollers 126 on ledge members 66. Sliding sash 26 is prevented from being removed from support frame 22 by a pair of circular stops 131 which are attached to sliding sash frame top member 104 by threaded fasteners which extend through a clearance hole provided in the center of stops 131 to engage within a threaded hole formed in top member 104. When an attempt is made to lift sash 26, stops 131 abut against lip 62 extending along support frame header 34, FIGS. 1 and 3. Since sliding sash 26 partially overlaps fixed sash 24 even when the sashes are in fully closed position, FIG. 2, if the sliding sash cannot be removed from support frame 22, then the fixed sash also cannot be removed.

Sashes 24 and 26 are disassembled from frame 22 by first removing stops 131 from top member 104. Next sash 26 is initially lifted upwardly to slide top member 104 far enough upwardly into front channel 54 to remove the sash frame bottom member 106 from channel 54 so that the lower portions of the sash frame can be swung laterally away from the support frame sill member 36. Thereafter the sash frame is simply lowered until the top member 104 slides downwardly out of channel 54. Fixed sash 24 is removed from frame 22 in like manner.

The meeting members 100 and 108, of fixed and sliding sash frames 92 and 94, respectively, are interlocked together to prevent relative transverse movement therebetween by lips 132 which extend diagonally outwardly from the adjacent surfaces of the two meeting members to interlock with each other, as best shown in FIGS. 2 and 5. Lips 132 extend substantially the full height of the meeting members to terminate a short distance below the upper surface of frame top members 96 and 104 and a short distance above the lower surface of frame bottom members 98 and 106. Because lips 132 transversely overlap center flange 52, they cannot extend the full length of sash frames 92 and 94, or else sashes 24 and 26 could not be installed into or removed from channels 54 and 56.

Next referring to FIGS. 2, 3, 5 and 6, sash frames 92 and 94 include a cntinuous, transverse groove 134 extending along the perimeter of the frames. In the region of lips 132, groove 134 is disposed beyond the ends of the lips so that there is no interference therebetween. Grooves 134 are shaped and sized to snugly receive the base portion of a continuous weatherstrip member 136. Weatherstrip members 136 preferably include a resilient, flexible, fibrous portion which extends outwardly through the mouth of grooves 134 to seal against the adjacent face of center flange 52, which flange lies in face to face relationship with the top, bottom and outside members of sash frames 92 and 94, and against the adjacent side surface of the other meeting member when sliding sash frame 94 is in closed position. As a consequence, a continuous, unbroken seal is formed between fixed sash 24 and the adjacent portions of support frame 22 and slidable sash 26. Also, a continuous, unbroken seal is formed between slidable sash 26 and the adjacent portions of support frame 22 and fixed sash 24. Thus, the likelihood of heat loss due to air passing through window structure 20 by flowing around the edges of fixed and sliding sash frames 92 and 94 is kept to a minimum.

As best illustrated in FIGS. 1 and 2, window structure 20 also commprises a latch mechanism 138 which includes a rib member 140 extending transversely outwardly from side wall 114 of outside member 110 of sliding sash frame 94. Rib member 140 extends along the length of outside member 110 to terminate a short distance above the lower surface of bottom member 106 and a short distance below the upper surface of top member 104 to thereby enable slidable sash 26 to be installed and removed from support frame 22 in the manner described above. A bead 142 of arcuate cross section is formed along the free edge of rib member 140. The width of bead 142 is significantly greater than the thickness of rib 140.

Latch mechanism 138 also includes an elongate latch plate 144 which is pivotally mounted on rib member 140 to extend transversely across the height of support frame 22. Latch plate 144 is formed in a generally Z-shaped cross section and includes a socket 146 of arcuate cross section extending along its length for engaging over rib member 140. The opening leading into socket 146 is large enough to permit latch 144 to pivot about the longitudinal axis of rib member 140. Latch plate 144 also includes a curved handle portion 148 which is manually graspable to actuate the latch plate, and a latching edge portion 150 which extends along the portion of the latch plate opposite handle portion 148. Latching edge 150 is adapted to hook over the portion of lip 62 extending along style member 38 to lock sash 26 in closed position as shown in FIG. 2, or to engage within aligned notches 64 formed in the portions of lip 62 extending along header member 34 and sill member 36 to thereby secure sash 26 in selective open positions as shown in FIG. 1. It is to be appreciated that latch plate 144 is capable of maintaining sliding sash 94 either locked in closed position or secured in selective open position whether the window structure is disposed horizontally as illustrated in FIG. 1 or rotated 90° to a vertical orientation. Moreover, the single, elongate latch plate can be conveniently operated by the use of only one hand. As illustrated in FIG. 2, latch mechanism 138 also includes a pair of U-shaped wire springs 152 for biasing latch plate 144 into latched position. One leg of springs 152 seats within a channel shaped slot 154 extending along the length of latch plate 144. Slot 154 is formed by one wall of socket 146 and by a L-shaped rib 156 extending along the length of latch plate 144 at a location between socket 146 and handle portion 148. The other leg of springs 152 seats within a corner defined by the intersection of rib member 140 and side wall 114 of sliding sash frame outside member 110.

Still referring to FIG. 2, window structure 20 further includes a screen sash 28 formed by a hollow sash frame 160 having a thickness corresponding to the thickness of fixed sash frame 92 to thereby enable screen sash 28 to fit within rear channel 56 of support frame 22 at a location alongside fixed sash frame 92. Sash frame 160 includes an inside side member 162 which abuts against meeting member 100 of fixed sash frame 92 and an outside member 164 which abuts against a lip 166 extending transversely of rear flange 44 of style member 38 to thereby prevent fixed sash 24 from sliding within channel 56. Other conventional means in addition to the blocking action of screen sash frame 160 may be utilized to prevent movement of fixed sash 24. Hardware cloth or screen material 168 is stretched over the opening formed by screen sash frame 160 and is held taut by a locking strip 170 which locks the edge portions of the hardware cloth within a U-shaped channel 172 formed along the inside edge of sash frame 160 in a manner which is conventionally known. Screen sash 28 is engaged within and removed from rear channel 56 in the same manner that fixed and slidable sashes 24 and 26 are installed into and removed from their respective channels, as discussed above.

Rather than being installed in a horizontal orientation as shown in FIG. 1, a window structure 20 can instead be orientated in a vertical position so that slidable sash 26 slides vertically up and down rather than horizontally. Even when window structure 20 is mounted vertically, latch mechanism 138 is fully operable to securely hold sliding sash 26 in selective open positions or locking sliding sash in fully closed position by engagement with lip 62 extending along stile member 38 which now functions as the sill member. In short, disposing window structure 20 in vertical position also provides all of the advantages available when the window structure is positioned in horizontal orientation as shown in FIGS. 1–6.

Figure 7:
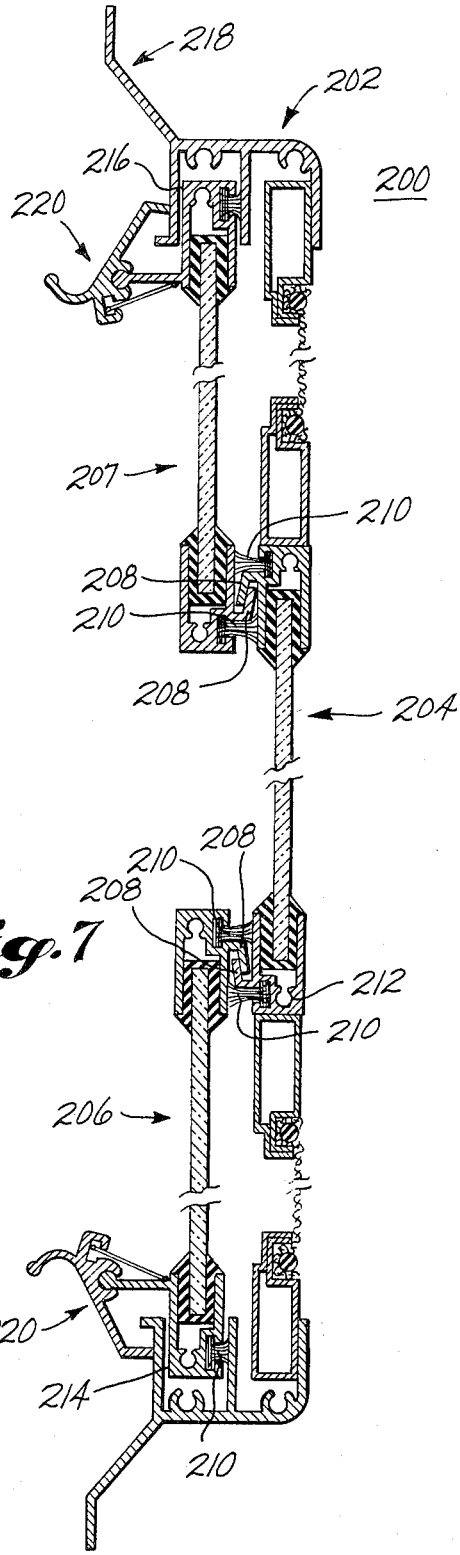
FIG. 7 is a horizontal cross-sectional view of another typical embodiment of the present invention depicting a window construction having two sliding sashes.

An alternative embodiment of the present invention is illustrated in FIG. 7 wherein a window structure 200 includes a support frame 202 for supporting a fixed sash 204 and two slidable sashes 206 and 207 located on each side of the fixed sash. With the exception of a difference in size, slidable sash 206 is constructed virtually identically to slidable sash 26 described above and illustrated in FIG. 2. Slidable sash 207 is constructed as a mirror image of slidable sash 206. Fixed sash 204 also is constructed virtually identical to fixed sash 24 described above and illustrated in FIGS. 2 and 3, with the exception that two lip members 208 are utilized rather than single lip member 136 of fixed sash 24. As with window structure 20, window structure 200 includes weather strip members 210 which extend around the entire perimeter of fixed sash frame 212 and sliding sash frames 214 and 216 to also provide a complete seal around each of these frames. Moreover, the mounting flange portion 218 and the latch mechanism 220 of window structure 200 are identical to mounting flange portion 32 and latch mechanism 138 of window structure 20 illustrated in FIGS. 1–6. Thus, window structure 200 includes all of the advantages provided by window structure 20, as discussed above.

Figure 8:
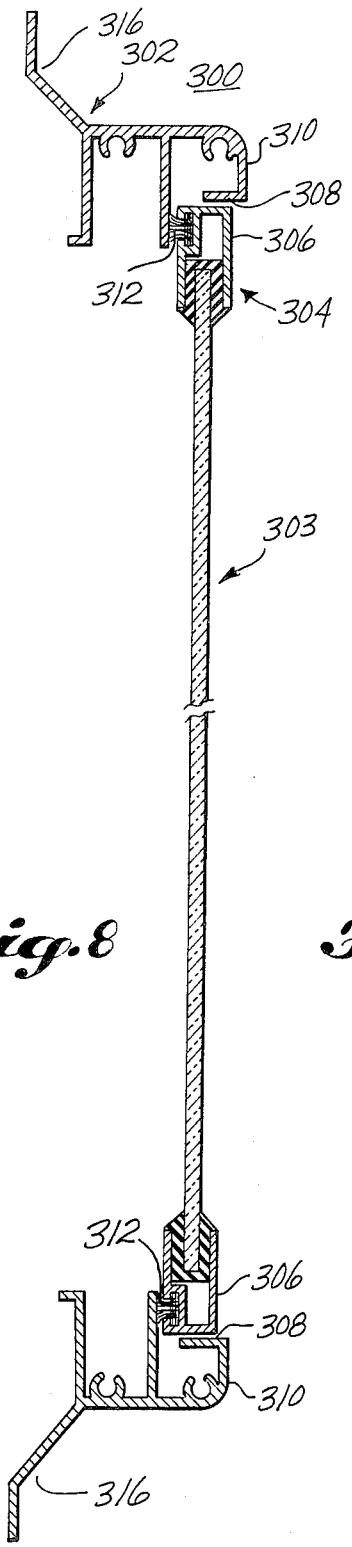
FIG. 8 is a horizontal cross-sectional view of one further typical embodiment of the present invention specifically illustrating a window construction utilizing a single fixed sash.

A further typical embodiment of the present invention is shown in FIG. 8 wherein a window structure 300 includes a support frame 302 for supporting a single fixed sash 303. Sash 303 includes a frame 304 having side members 306 that abut laterally against shoulders 308 extending transversely to outer flanges 310 of the sash frame. The sash frame top and bottom members, not shown, slidably engage within an outer channel, not shown, formed in the top and bottom members of support frame 302 in a manner similar to channel 56 illustrated in FIG. 3. Sash 303 is installed in and removed from support frame 302 in the same manner as screen sash 28 discussed above. Because sash 303 is designed to remain stationary, sash frame 304 does not include cross shafts having crowned heads, such as cross shafts 128 and crown heads 130 illustrated in FIG. 6. Sash frame 304 does, however, include a weatherstrip member 312 which extends continuously along the frame to extend transversely outwardly to seal against a central flange 314 formed in support frame 302 to thereby form an unbroken seal between sash 303 and support frame 302.

Support frame 302 includes a mounting flange portion 316 constructed identically to mounting flange portion 32 illustrated in FIGS. 1–6. Thus, mounting flange portion 316 also eliminates the need for a separate spacer when installing window structure 300 outwardly of an existing window to serve as a storm window.

As will be apparent to those skilled in the art to which the invention is addressed, the present invention may be embodied in specific forms and embodiments other than those specifically here disclosed, without departing from the spirit or essential characteristics of the invention. The particular embodiments of the window structures 20, 200, and 300, described above, are therefore to be considered in all respects as illustrative and not restrictive, i.e. the scope of the present invention is as set forth in the appended claims rather than being limited to the examples of the window structures set forth in the foregoing description.

I claim:

1. A window construction comprising:

a support frame including a channel portion having front and rear channel members separated by a substantially planar, central flange;

a first sash mounted within said rear channel, said first sash including a first sash frame with a flush, planar face extending around said first sash and disposed adjacent one face of said central flange;

at least one slidable sash mounted within said front channel for movement between an open and a closed position, said slidable sash including a second sash frame with a flush planar face extending around said slidable sash and disposed adjacent the face of said central flange opposite said first sash frame;

wherein each of said two sash frames includes meeting members extending transversely to the direction of travel of said sliding sash and disposed in side-by-side contacting relationship to each other when said slidable sash is in closed position; and weatherstrip means extending continuously along the length of and projecting transversely outwardly from the planar face of each of said sash frames toward the other sash; and mounting means pressing said weatherstrip means against the adjacent face of said support frame central flange and against an adjacent planar surface of said meeting member of the opposite sash frame, thus forming an unbroken seal around the entire perimeter of each sash.

2. A window construction according to claim 1, wherein said weatherstrip mounting means includes continuous groove means extending along each of said sash frames for snugly receiving said weatherstrip means, said groove means having a reduced width mouth in the portion of said sash frames adjacent said support frame central flange to permit said weatherstrip means to extend transversely outwardly from each of said sash frames.

3. The window construction according to claim 1, further comprising means for interlocking said meeting members together when said slidable sash is in closed position to prevent transverse movement of said two meeting elements relative to each other, said interlocking means including an elongate lip member disposed along substantially the entire length of the side of each meeting members adjacent the other sash frame, said lip member extending diagonally outwardly from its corresponding sash frame meeting member to interlock with said lip member of said opposite meeting frame member.

4. A window construction according to claim 1, further comprising latch means including an elongate latch plate pivotally mounted on said slidable sash frame opposite said meeting element to extend transversely across the width of said support frame and engage with portions of said support frame to secure said slidable sash in selective open positions or to lock said slidable sash in closed position, the said sash including portions defining a bead member of arcuate cross section extending along one edge portion of the sash, and the said latch plate including portions defining an elongate socket of arcuate cross section extending along the length of said latch plate for snugly, pivotally receiving said bead member, and an elongate hooked free edge portion spaced from said socket and substantially spanning said sash.

5. A window construction according to claim 4, wherein:

said slidable sash frame includes an outer member extending along the side of said sash frame opposite said meeting member, a rib member disposed substantially along the entire length of said frame outer member and extending generally transversely outwardly from said frame outer member in a direction opposite said first sash, and a bead member of arcuate cross section extending along the free edge of said rib member opposite said frame outer member;

said latch plate includes portions defining an elongate socket of arcuate cross section extending along the length of said latch plate for snugly pivotally receiving said beam member, and an elongate, hooked free edge portion spaced from said socket;

said support frame includes a pair of spaced parallel longitudinal members extending along the direction of travel of said slidable sash, and first and second end members disposed in spaced parallel relationship transversely to the direction of travel of said slidable sash to interconnect the end portions of said longitudinal members, said support frame first end member adapted to slidably receive said sliding sash frame outer member when said sliding sash is in closed position;

a keeper lip extending transversely outwardly from said support frame first end member to engage with said latch plate edge portion to maintain said sliding sash in locked position;

said longitudinal members having portions defining a series of aligned notches located along the length of said longitudinal members for receiving said latch plate edge portion to secure said sliding sash in selective open positions; and urging means urging said latch plate edge portion into engagement with said keeper lip or said notches.

6. A window construction comprising:

a support frame including a front flange, a rear flange disposed substantially in spaced parallel relationship to said front flange, a web interconnecting the outer edge portions of said front and rear flanges to form a generally U-shaped cross section, and a substantially planar central flange disposed between and generally parallel to said front and rear flanges to divide said U-shaped cross section into a front and rear channel;

a first sash mounted within said rear channel, said first sash including a first sash frame with a flush, planar face extending around said first sash and disposed adjacent one face of said central flange;

at least one slidable sash mounted within said front channel for movement between an open and closed position, said slidable sash including a second sash frame with a flush, planar face extending around said slidable sash and disposed adjacent the face of said central flange opposite said first sash frame;

each of said two sash frames including a meeting member extending transversely to the direction of travel of said sliding sash and, said meeting members being disposed in overlapping, contacting relationship when said slidable sash is in closed position;

weatherstrip means;

extending within the interior of said two sash frames continuously along the length of and projecting transversely outwardly from the planar face of each of said two sash frames toward the other sash a distance sufficient to press said seal means against the adjacent face of said support frame central flange and against an adjacent surface of said meeting element of the opposite sash frame, thus forming a continuous, unbroken seal around the entire perimeter of each sash; and means for interlocking said two meeting elements together when said slidable sash is in closed position to prevent relative, transverse movement of said two meeting elements.

7. A window construction according to claim 6, wherein said interlocking means includes an elongate lip member extending along the length of each sash frame meeting member and terminating a short distance from the ends of said meeting members, each of said lip members extending diagonally outwardly from a corresponding meeting member toward the other meeting member to engage and interlock with each other when said slidable sash is in closed position.

8. A window construction according to claim 6, wherein said sliding sash frame includes an outer member extending along the side of said sliding sash opposite said meeting member; and further comprising latch means including an elongate catch plate pivotally mounted on said sliding sash frame outer member to extend transversely across the width of said support frame and engage with portions of said support frame front flange to maintain said slidable sash in selective open positions or to lock said slidable sash in closed position.

9. A window construction according to claim 6, further comprising a mounting flange surrounding and integrally formed with said support frame front and rear channels, said mounting flange including a diagonal section extending outwardly and forwardly from the intersection of said front flange and said web to extend forwardly of said front channel, and a perimeter section extending outwardly from the edge of said diagonal section opposite said front channel to lie in a plane substantially parallel to the planes defined by said support frame front and rear flanges.

10. A window construction according to claim 9, wherein the angle separating said mounting flange diagonal section and perimeter section is approximately thirty to fifty degrees.

11. A latch for a window construction having at least one slidable sash slidably mounted on a support frame which surrounds the slidable sash, said latch comprising an elongate latch plate pivotally mounted on said slidable sash to extend transversely across the entire width of the support frame to engage with portions of the support frme to secure the slidable sash in selective open positions or to lock the slidable sash in closed position, the said sash including portions defining a bead member of arcuate cross section extending along one edge portion of the sash, and the said latch plate including portions defining an elongate socket of arcuate cross section extending along the length of said latch plate for snugly, pivotally receiving said bead member, and an elongate hooked free edge portion spaced from said socket and substantially spanning said sash.

12. A latch for a window construction comprising:

at least one slidable sash slidably mounted on a support frame which surrounds the slidable sash, including portions defining a bead member of arcuate cross section extending along one edge portion of the sash;

said latch comprising an elongate catch plate pivotally mounted on said slidable sash to extend transversely across the entire width of the support frame to engage with portions of the support frame to secure the slidable sash in selective open positions or to lock the slidable sash in closed position;

said latch plate includes portions defining an elongate socket of arcuate cross section extending along the length of said latch plate for snugly, pivotally receiving said bead members, and an elongate hooked free edge portion spaced from said socket;

the support frame includes a pair of spaced parallel longitudinal members extending along the direction of travel of the slidable sash, and first and second end members disposed in spaced parallel relationship transversely to the direction of travel of the slidable sash to interconnect the end portions of said longitudinal members;

a keeper lip extending transversely outwardly from the support frame first end member to engage with said latch plate edge portion to maintain the sliding sash in locked position; and said longitudinal members having portions defining a series of aligned notches located along the length of said longitudinal members for receiving said latch plate edge portion to secure the sliding sash in selective open positions.

* * * * *